United States Patent [19]

Wardlaw

[11] 4,216,834

[45] Aug. 12, 1980

[54] CONNECTING ASSEMBLY AND METHOD

[75] Inventor: Harold W. R. Wardlaw, Houston, Tex.

[73] Assignee: Brown Oil Tools, Inc., Houston, Tex.

[21] Appl. No.: 890,813

[22] Filed: Mar. 27, 1978

Related U.S. Application Data

[63] Continuation-in-part of Ser. No. 736,396, Oct. 28, 1976, Pat. No. 4,081,039.

[51] Int. Cl.[2] ..... E21B 15/02

[52] U.S. Cl. ..... 175/7; 166/350; 166/367; 405/224

[58] Field of Search ..... 175/5, 7, 8, 9, 10; 166/0.5, 0.6, 367, 359, 362, 350; 138/112–114

[56] References Cited

U.S. PATENT DOCUMENTS

| | | | |
|---|---|---|---|
| 1,753,511 | 4/1930 | Grant | 175/5 |
| 3,017,934 | 1/1962 | Rhodes et al. | 175/7 |
| 3,354,951 | 11/1967 | Savage et al. | 166/0.6 |
| 3,465,817 | 9/1969 | Vincent | 175/7 |
| 3,721,292 | 3/1973 | Ahlstone | 175/7 X |
| 3,858,401 | 1/1975 | Watkins | 175/7 X |
| 3,992,889 | 11/1976 | Watkins et al. | 175/7 |
| 4,040,264 | 8/1977 | Neilon | 175/7 |
| 4,059,148 | 11/1977 | Blomsma | 166/0.5 |

*Primary Examiner*—Ernest R. Purser
*Assistant Examiner*—Richard E. Favreau
*Attorney, Agent, or Firm*—Browning, Bushman & Zamecki

[57] ABSTRACT

Diclosed is a connecting assembly for communicating between a first location and a second location lower than the first location, with the two locations separated by a fluid body. A first tube extending between the two locations generally encloses a second tube, and the annular area between adjacent surfaces of the two tubes is sealed toward the second location. The buoyancy of the assembly is selectively controlled by selectively controlling the quantity and density of fluid in the area between the tubes. In an embodiment shown, a marine drilling facility is joined to an underwater well site by a riser with a liner set and sealed therein, and gas-lift pumping is used in controlling buoyancy. In a method, a riser is set between an underwater well site and a marine well operating facility. A first segment of the well may be drilled through the riser. Casing is cemented in the well, and a liner is sealed at its bottom end to the riser. Air and jet lines are positioned in the area between the liner and the riser to control the density and quantity of fluid in that area. Continued drilling may occur through the liner and the casing. The connecting assembly may also be constructed by extending a first tube between two locations and generally enclosing a second which is anchored to the riser toward both ends and held in tension. In a method, a riser is set. Then, a liner is positioned within the riser, and anchored to the riser near the bottom of the liner. The liner is then pulled up on relative to the riser, and anchored at the top to hold the liner in tension and to prevent it from slipping downwardly relative to the riser.

35 Claims, 10 Drawing Figures

CONNECTING ASSEMBLY AND METHOD

This is a continuation-in-part of application Ser. No. 736,396, filed Oct. 28, 1976, now issued as U.S. Pat. No. 4,081,039, issued Mar. 28, 1979.

BACKGROUND OF THE INVENTION

1. Field of the Invention

The present invention relates to apparatus and methods for making underwater connections. More particularly, the present invention pertains to marine riser assemblies with controlled buoyancy, riser assemblies with pre-tensioned liners, and to methods of assembling and using such riser assemblies in underwater drilling operations.

2. Description of the Prior Art

A marine drilling riser is a conductor pipe used in offshore drilling operations for oil and gas. It is installed between the well site on the underwater floor and the floating drilling vessel or semi-submersible unit. The purpose of the riser is to guide the drill string to and from the well site, and to provide means for circulation of drilling fluid.

The riser constitutes a tubular column. A flexible joint is used to connect the riser to the well site, but generally does not support the riser. If the riser is required to support its own underwater weight, the riser could buckle or bend in deep water situations where a significantly long riser is used. Increasing the diameter of such a riser gives it added strength, but also increases the riser's cross section to currents and wave action.

Various types of tensioners have been proposed and/or employed in attempting to maintain a constant upward pull on the risers to relieve some of the weight supported by them. Since the tensioning devices are attached to the vessel, its heave must be compensated by the tensioners. However, in practice, fluctuations in such upward pull occur as the drilling vessel rises and falls in response to wave action, and the tensioners, whether mechanical or pneumatic, are not always able to respond to such vessel motion rapidly enough to maintain a constant force on the riser. In theory, both tension and position of the top of the riser are kept constant; but since there is no point of reference available, it cannot be determined whether the top of the riser actually remains still. In rough weather both the water surface and the vessel move independently, and even completely constant tension on the tension devices is no guarantee of lack of riser movement. For risers of three or four hundred feet in length, a few feet of movement can move the riser from a completely top-supported condition to a "squatted" condition in which the riser is bottom supported, and subject to dangerous buckling and failure.

Another disadvantage of relying solely on tensioners to support the riser is that the supporting force is applied only at the top of the riser. Since the riser is never maintained absolutely vertical, the tensioners should support the weight of the riser plus the weight of the drilling fluid less the weight of the water displaced by the riser. The drilling fluid is distributed along the length of the riser. Consequently, the net buckling load at every point on the riser is generally the sum of the weight of the riser below that point and the weight of the drilling fluid above that point, less the weight of the total volume of water displaced. Additional loading on the riser occurs due to any equipment suspended within the riser and to increases in the density of the drilling fluid column. Then, with tensioners supporting the riser only at its top where they are anchored on the drilling vessel, the continuously distributed load on the riser can still cause the riser to buckle.

Buoyancy tanks may be attached at one or more points along the length of the riser to provide lift to the riser. However, such tanks added to the riser increase the cross section and, therefore, the resistance of the assembly to currents. Also, to obtain a distribution of increased buoyancy along the riser, multiple tanks must be provided. Furthermore, once these tanks are installed, the buoyancy provided by the tanks cannot be adjusted to suit environmental or other condition changes. Thus, the danger of a positive buoyancy coupled with a break in the riser cannot be met by reducing the buoyancy so as to prevent the sudden rise of the riser assembly and its possible collision with the drilling vessel.

An additional disadvantage of fixed-buoyancy riser assemblies is experienced when, in the event of a threatened storm or rough water conditions, the riser assembly is disconnected at the well site. However, with fixed, slightly negative buoyancy, the disconnected riser will then weave below the vessel, making manipulation of the riser difficult.

Foams may be utilized as floatation material to add buoyancy to a riser. However, such a technique is but another form of fixed buoyancy method. In addition, foams tend to take on water when subject to undersea pressures, thereby reducing their effectiveness.

U.S. Pat. No. 3,858,401 discloses a system of open-bottomed buoyancy chambers surrounding the riser at various levels. Gas under pressure is fed into each chamber to displace sea water therefrom. A separate valve, actuated to close when a predetermined level of water is reached in the respective chamber, controls the flow of gas into that chamber. Gas removing means, such as a bleed line, can be used to reduce the buoyancy of each chamber. These buoyancy chambers, like the buoyancy tanks described hereinbefore, present an enlarged cross section to currents, and, as longer risers are used, more such chambers are needed.

Since the load on the riser at any point depends on the drilling fluid weight, the load on the riser can be reduced at virtually all points by lowering the density and/or quantity of drilling fluid contained within the riser. U.S. Pat. No. 3,434,550 discloses a system whereby the drilling fluid circulating upwardly within the annular region between the riser body and the drill pipe contained therein may be aerated to lower the fluid density. In this manner, the hydrostatic head of the drilling fluid in that annular region may be reduced to lighten the load on the riser. However, the system of that patent employs one or more gas manifolds external to the riser, and exposed to the currents. Furthermore, to maintain a constant buoyancy of the riser, gas must continuously flow through the circulating drill fluid.

It is known that tension may be used to improve the stiffness of various structures. For example, an airplane wing may be provided with inner tension wires to improve the resistance of the wing to bending arising from lift acting on the wing. Also, many reinforced concrete piles are prestressed during the casting process. Thus, the inner reinforcing steel is left in tension, while the concrete comprising the bulk of the pile remains in compression, during and after the driving process.

In the drilling of offshore wells from stationary platforms, inner casing strings are now often suspended from below the mud line. However, at one time it was common to suspend all such casing from the top, as for landbased wells, thus throwing the outermost string extending down to the mud line into compression. As water depth increased, centralizers were placed between the outer string and the next inner string, which was in tension, to combat possible buckling by the compressed outer string. Thus, though the outer string may buckle a small amount, the buckling is arrested by the inner string, as with airplane wings and prestressed piles.

SUMMARY OF THE INVENTION

Apparatus of the present invention include a riser in the form of a tubular member extending from a surface drilling facility, or vessel, down to a well site on the sea bottom. The riser is connected by a universal joint to the well site. A slip joint connects the top of the riser to the drilling facility. A liner, extending generally the length of the riser, is set within the riser. In one form of the apparatus, a single liner hanger may be used to fasten the liner top end to the interior of the riser in the vicinity of the drilling facility. Then, a packer, or other sealing device, seals the liner near its bottom end to the interior surface of the riser in the vicinity of the well site. The liner may also be sealed to the riser at the top end of the liner. An additional variation includes hanging the liner at any point below the top of the riser.

The liner may be selected to have a diameter equal to the diameter of protective casing cemented in the first segment of the well to be drilled. Since this liner diameter is necessarily smaller than the interior diameter of the riser, a generally annular area is defined between the outer surface of the liner and the inner surface of the riser, with a bottom determined by the aformentioned packer, and with a top end near the liner top. Material within this annular region may be removed only from the top thereof, that is, at the drilling facility end.

A pair of tubes extends down into the annular area from the drilling facility to the region just above the packer. These tubes include a gas inlet line and a jet line. The lower end of the gas line is turned upwardly and dovetails with the flared, downwardly directed end of the jet line.

During the setting of the liner within the riser, fluid, such as drilling mud and/or sea water, is trapped in the annular region above the packer. The weight of the entire assembly may be altered by thereafter controlling the amount and density of this trapped fluid. In general, removing a quantity of this fluid from the annular area increases the buoyancy of the entire riser assembly. To effect such removal, gas, such as air, is forced down the gas inlet line to be bubbled into the jet line. The jet line contains a quantity of the trapped fluid. Gas bubbles moving up through this fluid in the jet line decrease the density of the fluid, causing it to be pushed up the jet line by more dense fluid entering through the flared bottom of the jet line. In this way, fluid may be selectively removed from the annular area by control of the input of the gas into the gas inlet line. If necessary, gas lift valves may be used to join the gas inlet line to the jet line at positions along the riser to further decrease the density of the fluid contained in the jet line. Also, by permitting introduction of gas at higher positions along the jet line, such gas lift valves make it possible to manipulate liquid in long riser assemblies, or relatively dense liquids, without the need of a large pressure gas source at the drilling facility. Additional pairs of gas inlet and jet lines may be placed within the annular region for increased buoyancy control. Also, if it becomes necessary to decrease the buoyancy of the riser assembly, additional fluid may be introduced into the annular region by reverse pumping such fluid down the jet line. A check valve at the lower end of the gas inlet line prevents the fluid from entering the inlet line.

After a section of the well has been drilled and lined with casing, a drill bit of diameter smaller than that of this casing must be used for continued drilling. Before such drilling is resumed, however, the liner may be replaced in the riser by one of smaller internal diameter, i.e. a diameter just large enough to accomodate the smaller drill bit. Such a reduction in liner size can be effected whenever the drill bit size is reduced to pass through casing set in the well. An advantage of using the smallest diameter liner possible is that the weight of the liner, which contributes to the load on the riser, is kept to a minimum.

In another form of the apparatus, a liner is first anchored to the riser near the bottom of the liner, then tension is applied to the liner by pulling up on the liner relative to the riser. The top of the liner is then anchored to the riser by a second anchoring device, leaving the liner under tension. Consequently, even though the riser may, at times, be under compression, the liner is kept in a state of permanent tension, over and above the tension provided externally by the tensioners joining the riser assembly to the vessel, or by buoyancy.

The riser assembly with tensioned liner may also feature buoyancy control as described hereinbefore. The liner is sealed as well as anchored to the riser near the bottom of the liner, and the amount and density of fluid in the annular region between the riser and the liner may be controlled by use of gas inlet and jet lines.

To add to the stiffness of the riser assembly with pre-tensioned liner, with or without the buoyancy control feature, centralizers may be positioned between the riser and the liner.

In a method of the invention, a riser tube is extended from a drilling facility on the surface of a body of water down to an underwater well site. The riser tube is appropriately set, flexibly coupled to the drilling facility at the top end and to the well site at the bottom end. A first segment of the well is drilled by passing a drill string with a drill bit down through the riser. Then, casing is passed down through the riser, and cemented into place in this first segment in a manner well known in the art. A liner, of diameter equal to the casing diameter, is set within the riser. The liner is hung from adjacent the top of the riser, and a packer or other sealing device is set between the liner and the riser near the base of the liner. Continued drilling of the well, with a smaller diameter drill bit, can take place through the liner and casing that has been cemented in the first well segment.

A variation of the method includes drilling the first well segment through a liner within a riser. In such a case, this liner would be the same diameter as the riser used without a liner for drilling the first well segment, if the drill bit size for the first well segment is the same. Then a larger diameter riser would be needed. The advantage of this variation, however, it that the buoyancy of the riser assembly may be controlled from the start of the operation. This control may be especially important where the well is in deep water.

The fluid that is trapped between the liner and the riser above the packer may be removed from that region, or decreased in density, to increase the buoyancy of the entire assembly as needed. Furthermore, additional fluid may be pumped down into that region to decrease the buoyancy as needed.

As the well is drilled, additional casing members may be lowered through the liner and cemented in place below the first casing in the first well segment. The subsequent casing members are of smaller diameter than the original casing, being able to pass down through the liner that is set within the riser. Similarly, as the well is dug to a deeper level, the diameter of the drill bit must be reduced. The ability of the drilling mud in the well to counter deep hole formation pressure is not affected by the decreasing diameter of the well bore itself. As each additional casing segment is cemented in place in the well, a new liner, of diameter equal to that of the last cemented casing, may, if needed, be set within the riser, replacing a prior larger diameter liner. Each new liner in turn is sealed to the riser with a packer, and provision is made for removing fluid from, or adding fluid to, the annular region formed between the liner and the riser. Consequently, as drilling progresses, and the density of drilling mud used is increased to accommodate greater downhole pressures, the buoyancy of the riser assembly continues to be selectively controlled. The total amount of fluid that may be removed from the annular region between the liner and riser thus defined within the riser assembly increases as the liner diameter decreases, and the annular region covers a greater amount of the riser assembly transverse cross section available for buoyancy control.

Apparatus and method of the present invention provide riser assemblies with several distinct advantages. Such an approach to underwater drilling permits the drilling to proceed with the minimum weight of the mud column in the riser, since the liner installed within the riser may be changed following the running and setting of casing, allowing the minimum diameter liner to be used at all times. Furthermore, it is possible to use a liner of a diameter smaller than the last set casing, and to drill with a correspondingly smaller drill bit in conjunction with an underreamer to continue the well bore below the last set casing. With such extensive control over the quantity and density of fluid trapped in the annular region described hereinbefore, the drilling operation may proceed with the riser assembly under positive, neutral or negative buoyancy as desireable under various environmental and other conditions. The steps of the present method, as well as the apparatus employed, occur generally within the lateral dimensions of an ordinary riser tube. Consequently, the present invention does not generally increase the cross section of the riser assembly exposed to currents and wave action. If desired, the riser may additionally be secured to the sea floor by anchors to further prevent a possible undesired surfacing of the riser under positive buoyancy conditions should the riser inadvertently be broken. Finally, use of the minimum size liner within the riser allows high upward velocity of drilling fluid to be maintained by keeping the cross section of such fluid flow up the liner to a minimum size.

Another variation of the method of the invention includes placing the liner positioned within the riser under tension. To place such a liner under tension, the liner is anchored to the riser near the bottom of the liner. An upward pull is applied to the liner relative to the riser. This differential pull between the liner and the riser adds a tensioning force to the liner beyond, and independent of, the top support given to the riser by the vessel tensioners. Such riser support is normally provided to balance the weight of the entire riser assembly in water, and to add an extra pull to overcome the effects of wave action and avoid possible bending by the riser. If desired, the liner bottom may also be sealed to the riser. Such anchoring and sealing of the liner to the riser may be achieved with the use of a packer that includes anchoring devices as well as seals. With the liner under tension, the top of the liner is anchored to the riser also. If the liner bottom has been sealed to the riser as well, the buoyancy of the riser assembly may be controlled as in the case of the non-tensioned liner.

It will be appreciated that method and apparatus of the present invention can be used to control the buoyancy of a riser assembly at any time during operation between a drilling vessel and an underwater well site as well as when disconnected from the well site. Thus, positive buoyancy may be attained for simply supporting the riser assembly during routine drilling or when disconnected. When the riser is disconnected from the well site in the event of a threatened storm, negative buoyancy may be used to keep the riser assembly positioned below the drilling vessel, without weaving or extreme motion of the riser. Negative buoyancy may also be used as a safety feature when the drill string is being run in or out of the well bore. The buoyancy of the riser assembly may be controlled and altered over a wide range of values, generally positive, neutral and negative, as required. The buoyancy may be changed at will, and as fast as the appropriate fluid pump systems can operate to add gas or liquid to the riser. Once a buoyancy value is achieved, it may be maintained without continued pumping of gas or liquid to do so. The present invention also provides riser assemblies with increased stiffness by maintaining the liner located within the riser under permanent tension. Such a riser assembly may be expected to behave in a manner characteristic of other known prestressed structures, such as airplane wings and some reinforced concrete piles. Even when deprived of most of its external support, the prestressed riser assembly would retain considerable stiffness, especially if provided with centralizers between the riser and the liner.

DESCRIPTION OF PREFERRED EMBODIMENTS

Figure 1:
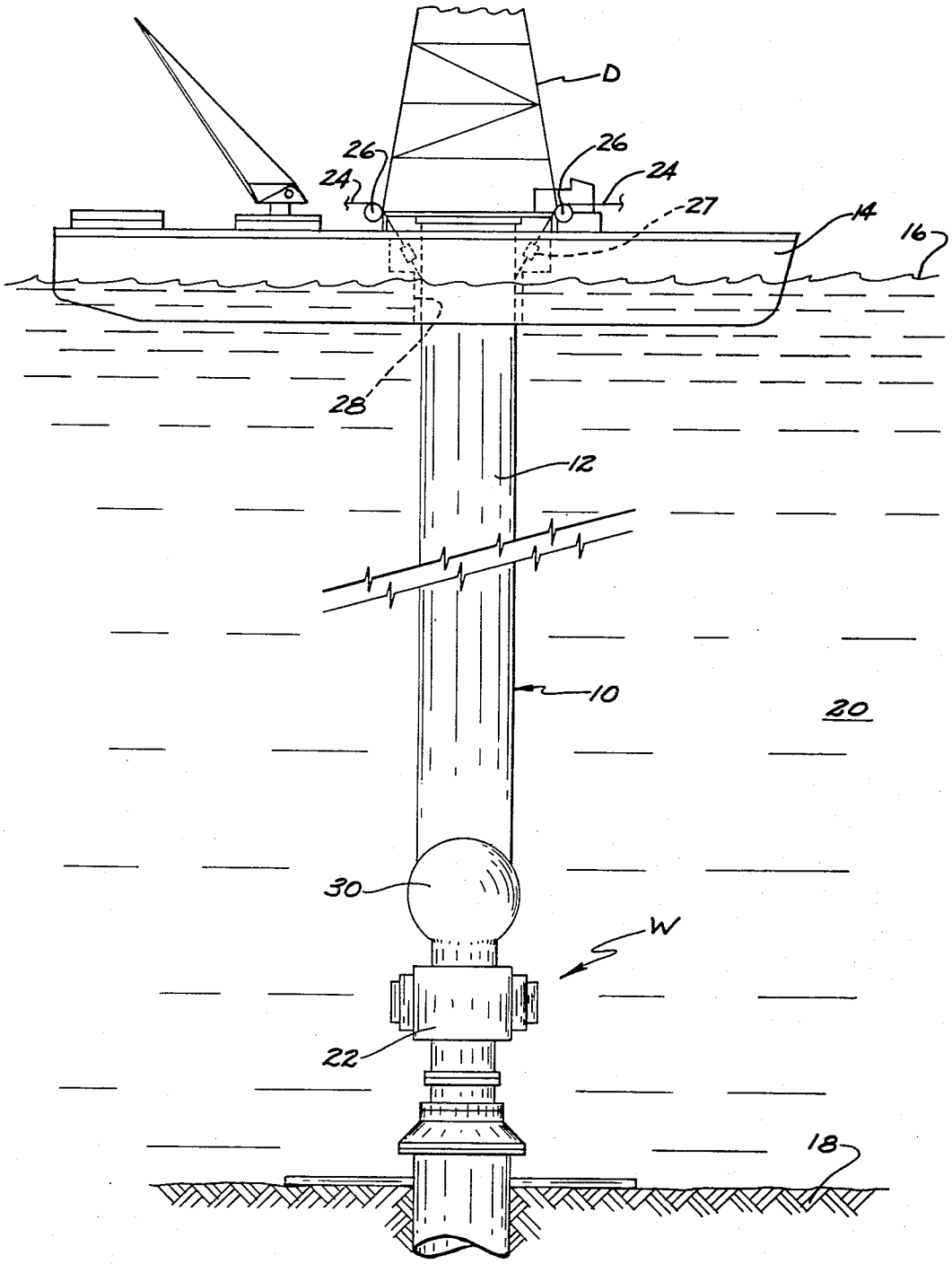
FIG. 1 is a partial, schematic side elevation showing the type of riser tube used in the present invention extending from a drill ship down to a well site on the sea bottom.

A riser assembly according to the present invention is shown generally at 10 in FIGS. 1 through 4. In FIG. 1, a riser, or riser tube, 12 is shown extending from a drill ship, or other marine well operating facility, 14 at the water surface 16 down to a well site, shown generally at W, on the floor 18 of the body of water 20. A blowout preventer 22 is shown fixed to the well head. The drill ship 14 is fitted with a derrick D and other pertinent well-working paraphenalia known in the art. Cables 24 are fixed to the riser 12 near its top end, and pass over sheaves 26 to anchoring devices (not shown). The cables 24 may be operated on winches, or tensioning devices, to maintain the top of the riser at a desirable and workable elevation relative to the drill ship 14, while accommodating the rises and falls of the drill ship due to wave and tidal action. The cables 24 also support the weight of the riser assembly 10, and maintain tension along the riser to prevent its buckling. Tensioners 27 are integrated in the cables 24 to act as shock absorbers between the ship 14 and the pull of the riser assembly as the ship responds to wave action. The riser 12, as well as other equipment to be passed down to the well site W, passes through a passage 28 extending through the bottom of the ship. Additional details of the drill ship 14 and its related equipment are well known in the art. Also, a semi-submersible drilling facility, or even a drilling platform, may be used with the invention in place of the drill ship 14.

Figure 2:
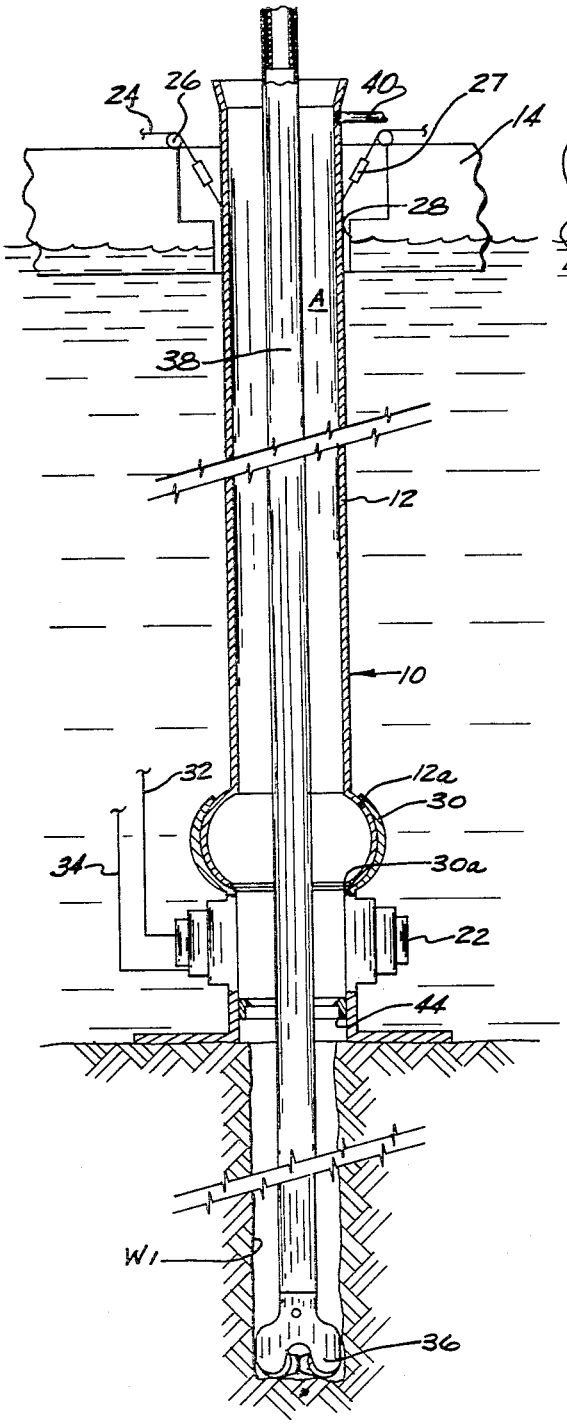
FIG. 2 is a partial cross sectional view, partly schematic, showing a riser with a first well segment being drilled through the riser.
Figure 3:
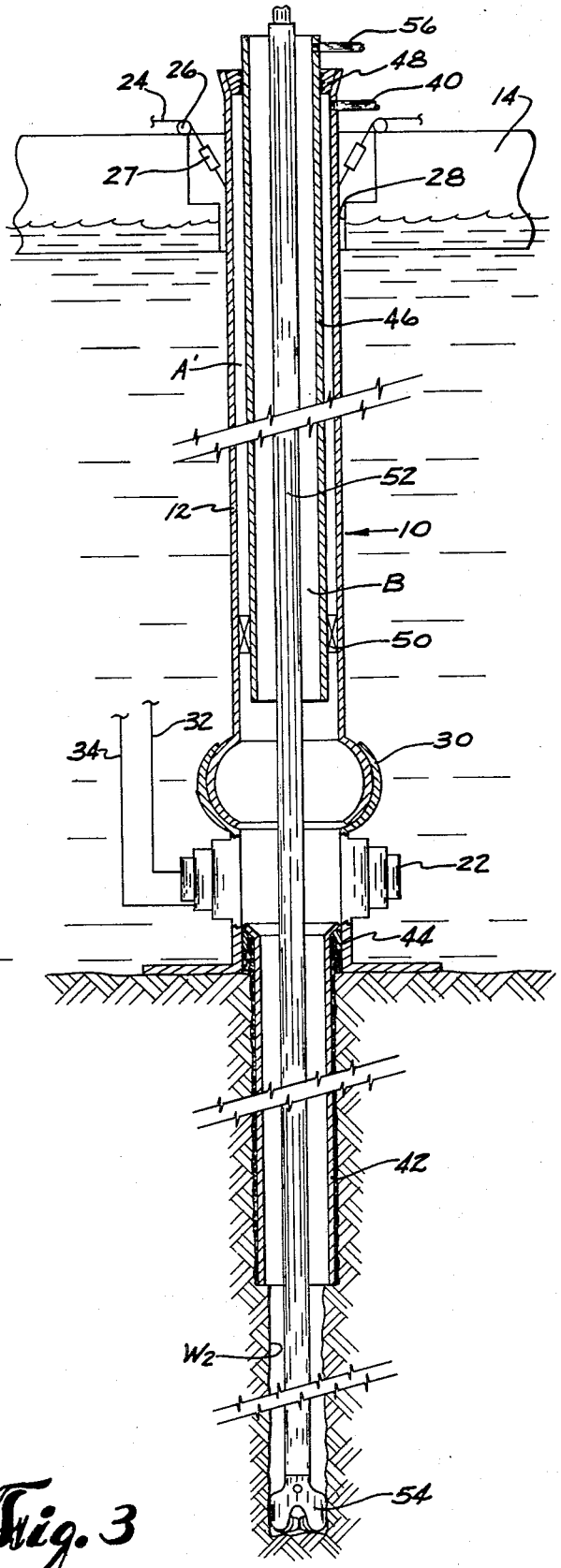
FIG. 3 is a view similar to FIG. 2, but showing continued drilling of the well bore with a smaller drill bit having passed through a liner set and sealed within the riser, and a casing member cemented in place in the first well segment.

A universal joint 30 provides a flexible anchoring for the riser 12 at the well site W, as best seen in FIGS. 2 and 3. This universal joint 30 is generally of a ball-and-socket type, with an extension 12*a* of the riser 12 acting as a ball fitted within the curved outer restraints of the socket. Any appropriate type of universal joint may be used provided a passage 30*a* is available for passing equipment down through the joint 30, and provided the joint permits the riser 12, and equipment suspended therefrom, to be able to tilt in all directions relative to the vertical.

The blowout preventer 22 is connected to the drill ship by a kill line 32, and a choke line 34, both well known in the art. The blowout preventer 22 is designed to automatically seal off the annular space surrounding the drill string if the down hole pressure rises above a predetermined level. Then, if necessary, the kill line 32 may be used to pump fluid down the annular space into the well bore to keep that annular region full of fluid, or, if needed, the choke line 34 may be used to circulate fluid from the bottom of the annular space in the riser to the drill ship if the pressure in the riser column has increased beyond a predetermined level. The blowout preventer 22, kill line 32 and choke line 34 are well known safety devices used in drilling operations.

In FIG. 2, a first segment of the well bore W1 is shown being drilled with the use of a drill bit 36 being driven by a drill string 38. Drilling fluid or mud is passed down through the interior of the drill string 38 and out through the drill bit 36 to be circulated back toward the drill ship 14. This drilling fluid passes through an annular region A between the exterior surface of the drill string 38 and the interior surface of the riser 12. A conduit 40 is provided at the top of the riser 12 to remove the circulated drilling fluid from the riser. As in other drilling operations, the drilling fluid serves the purpose of washing out cut material from the well bore and providing hydrostatic pressure to overcome downhole formation pressures to prevent a blowout.

FIG. 3 illustrates the drilling of a second well bore segment W2 of a diameter smaller than that of W1. Casing 42 has been cemented in place to line the first well bore segment W1. The well head is fitted with a casing hanger 44 (see FIG. 2) to support the casing 42 until the cementing operation is completed. This cementing operation may be performed by use of a cementing tool (not shown) temporarily supported by a hanger within the casing 42. Such operation is well known in the art, and neither the cementing method nor the particular apparatus used therein is further discussed herein.

With the casing 42 cemented in place, a liner 46 is set within the riser 12 as shown in FIG. 3. A liner hanger 48 supports the liner from the top of the riser 12, and a packer, or other sealing device, 50 seals the liner 46 to the riser toward the lower end of the liner. The liner hanger 48 may also seal the liner 46 to the riser 12. The sealing between the liner 46 and the riser 12 may also be achieved with the use of a polished bore receptacle. Thus, the annular area A is reduced in cross section to an area A′, and is closed at the bottom by the packer 50, while the conduit 40 still provides a means for communication external to the riser 12. A new annular area B is now defined between the interior surface of the liner 46 and the exterior surface of a new drill string 52.

The drill string 52 may be of smaller diameter than that of the drill string 38 previously employed. A drill bit 54 is operated at the bottom of the drill string 52. This drill bit 54 is of small enough cross section to be passed through the casing 42. The reduction in size in the drill bit 54 compared to the first drill bit 36 makes it possible to use a liner 46 that is equal in diameter to the casing 42. A larger diameter liner would be heavier than the liner 46. Thus, the drill bit size places a lower limit on the diameter of the liner that may be used, and thereby controls the possible reduction of weight of the riser assembly 10.

As the second well bore segment W2 is being drilled, drilling fluid is passed down the drill string 52 and out through the drill bit 54. This drilling fluid passes up through the casing 42 and the liner 46. A conduit 56 provides means for tapping this drilling fluid from the interior of the liner 46.

It will be appreciated that the drilling of the first well bore segment W1 may be performed through a liner within the riser 12, as shown in FIG. 3. Then, the liner used would have to be of sufficient diameter to allow passage therethrough of the drill bit 36. To accommodate such a large liner, the diameter of the riser 12 might have to be increased.

It may be appreciated that, as the drilling progresses to greater depth, it generally becomes necessary to provide increased pressure with the drilling fluid to balance formation pressures of greater quantity. However, by circulating the drilling fluid to the greater depth of FIG. 3 through a narrower drill string 52 and the liner 46, the total weight of the drilling fluid being circulated within the riser assembly 10 may be made smaller than the weight of the drilling fluid circulated down the drill string 38 and up through the annular area A as shown in FIG. 2. This reduction in weight of circulated drilling fluid being enclosed within the riser assembly 10 is achieved by simply reducing the total cross sectional area of the drilling fluid column. This decrease in circulated drilling fluid supported by the riser assembly 10 does not reduce the hydrostatic head available at the downhole location of the drill bit 54, for example, since this pressure depends upon the height of the drilling fluid column, and not its transverse cross sectional area.

When the liner 46 is set and sealed within the riser 12, drilling fluid may be trapped within the annular region A'. Also, some sea water may remain in this area, having been trapped therein when the riser 12 was originally set and joined to the universal joint 30. The disposition of the combined fluid within the annular region A' may best be appreciated by reference to FIG. 4. A gas inlet line 58 and a jet line 60 enter the riser 12 at the drill ship, and extend down into the area A' to the vicinity of the packer 50. The jet line 60 ends in a flared opening 60*a* facing downwardly. The gas inlet line 58 curves 180° to face upwardly, with its end 58*a* aligned with and facing the flared jet line opening 60*a*. A check valve (not shown) is fitted to the gas inlet line end 58*a* to prevent drilling fluid and sea water from backing into the gas inlet line 58.

With the jet line 60 in position in the annular area A', drilling fluid and sea water contained therein may pass up the flared opening 60*a* into the interior of the jet line. When it is desired to reduce the total weight supported by the riser assembly 10, gas, such as air or some inert gas, may be pumped down the gas inlet line 58 from the drill ship. This gas emerges through the check valve in the bottom end 58*a* of the inlet line, enters through the flared jet line opening 60*a* and bubbles up through the fluid contained in the jet line 60. The fluid within the jet line 60 decreases in density due to the action of the gas bubbles, and is forced up through the jet line by more dense fluid entering the flared opening 60*a* under influence of the hydrostatic pressure of the annular fluid column contained within the area A'. The fluid so propelled up the jet line 60 may be removed from the riser assembly 10 at the drill ship. Thus, by controlling the pumping of gas into the gas inlet line 58, fluid may be selectively removed from the annular area A' with the result that the buoyancy of the riser assembly 10 may be increased. If necessary, fluid may be added to the annular area A', either through the conduit 40, or by reverse pumping fluid down the jet line 60. Thus, the buoyancy of the riser assembly 10 may be selectively increased or decreased.

Gas lift valves, indicated schematically at 62 and 64, provide additional passageways to introduce gas from the gas inlet line 58 to the jet line 60. Although only two such gas lift valves 62 and 64 are shown, additional gas lift valves may be used where the length of the gas inlet line 58 and that of the jet line 60 warrant. Each gas lift valve is adjusted to permit gas transmission to the jet line in response to the hydrostatic pressure in the jet line falling below a preselected value at the location of that gas lift valve. The higher the gas lift valve is located, the lower is the pressure valve to which the particular valve is adjusted to so respond. Consequently, the gas lift valves are adjusted so that, when gas is pumped down the gas inlet line 58 to lower the liquid density in the jet line 60, the highest gas lift valve 62 opens first to transmit the gas to the jet line. Then, as the liquid toward the top of the jet line 60 lowers in density, and the hydrostatic head at every point in jet line 60 is lowered, the next gas lift valve down the jet line, here, 64, opens. The gas lift valves continue to respond in this order as the hydrostatic pressure in the jet line 60 continues to fall until the gas from the gas inlet line 58 can bubble out of the check valve (not shown) at the inlet line end 58*a*, through the liquid at that location, and into the flared jet line end 60*a*. Gas lift valves are well known, and will not be further described herein.

Such use of gas lift valves permits the lowering of liquid density by gas lift when the hydrostatic pressure in the jet line is large without the need for raising the gas pressure at the gas inlet line end 58*a* to match the level of the liquid pressure at that point before the density of the liquid is at all lowered. A relatively long column of liquid in the jet line 60, and/or high density liquid in the jet line, could cause such high pressures as to require the use of gas lift valves, or a high pressure pump.

A method according to the present invention may be appreciated with reference to FIGS. 1–4. A riser 12 is flexibly joined at a submerged well site W, and to a drilling facility 14 at or near the water surface 16. Support apparatus, such as cables 24 and tensioners 27, act to keep the riser 12 under tension. A drill string 38 is passed down through the riser 12 to be used to drive a drill bit 36 to drill a well segment W1. The drill string 38 is withdrawn, and the well segment W1 is lined with cemented casing 42. A liner 46 is hung in the riser 12, and sealed to the riser near the bottom of the liner 12. A second drill string 52, narrower than the first drill string 38, is passed down the liner 46 to drive a drill bit 54 to continue drilling the well. Drilling the first well segment W1 through such a liner hung in the riser is an alternative step to initially drilling only through the riser.

As the drilling progresses, the well bore may continue to be lined with cemented casing. Also, progressively smaller drill bits may be used, thus making the deepening well bore of decreasing diameter, and allowing the liner hung in the riser 12 to be replaced with liners of smaller diameters.

During the drilling operation, drilling fluid is circulated down the drill string, out through the drill bit, and up the well bore to the riser 12. This drilling fluid serves to wash out cut material, and to balance the down hole pressure. Before the liner 46 is hung and sealed to the riser 12, the circulated fluid passes up the annular region A between the drill string 38 and the riser. Once a liner 46 is in place in the riser, the drilling fluid and cuttings pass up the annular region B between the drill string 52 and the liner 46.

Fluid trapped in the annular region A' between the liner 46 and the riser 12 when the seal 50 is set at the bottom of the liner is lowered in density and/or removed from that region to increase the buoyancy of the assembly. To lower that buoyancy, more fluid is added to that annular region. Gas lift, including operation of gas lift valves, is used to aerate the fluid within a jet line 60, to lower its density, thereby permitting larger density fluid in the annular region A' to force the liquid in the jet line upwardly, and eventually out of the annular region. The buoyancy of the assembly may then be made and maintained at any value ranging from the positive, through neutral, to the negative.

FIGS. 5–10 illustrate the construction and use of prestressed riser assemblies according to the present invention. Elements appearing in FIGS. 5–10 corresponding, in construction and function, to elements described hereinbefore in relation to FIGS. 1–4 are identified hereinafter by their same respective numbers, and are not further described in detail.

Figure 5:
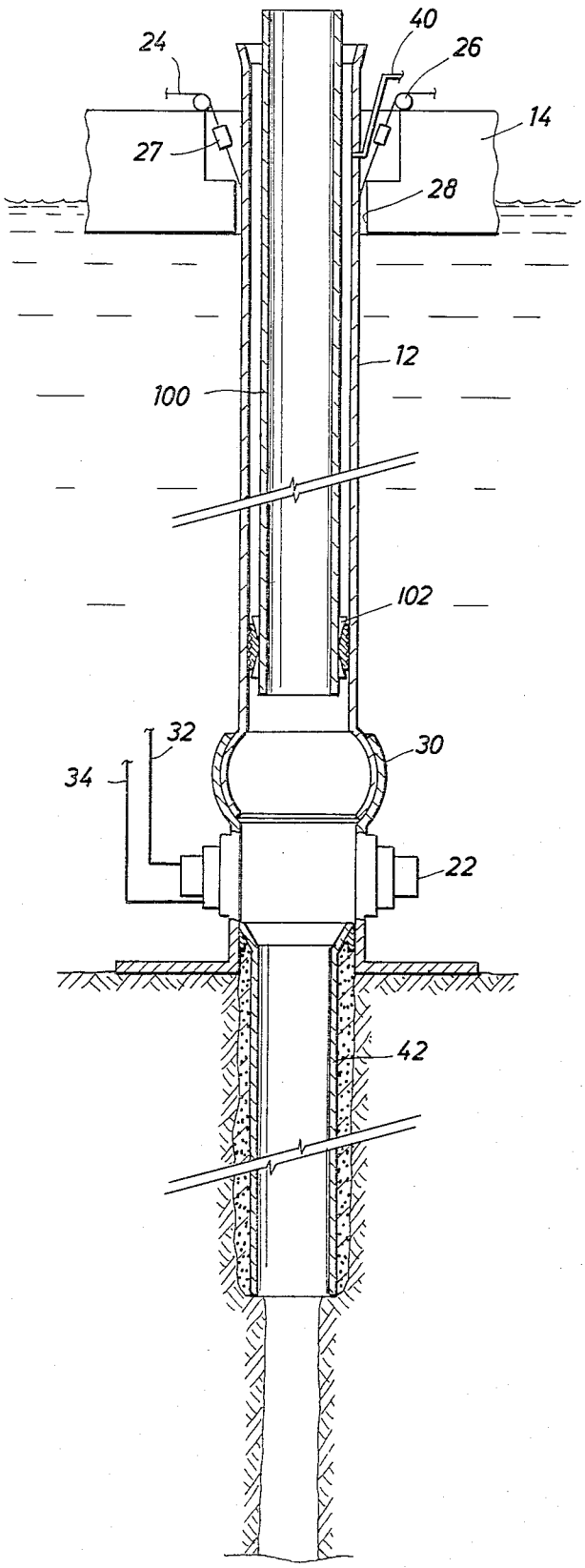
FIG. 5 is a partial cross sectional view, partly schematic, showing a liner anchored near its bottom within a riser.
Figure 6:
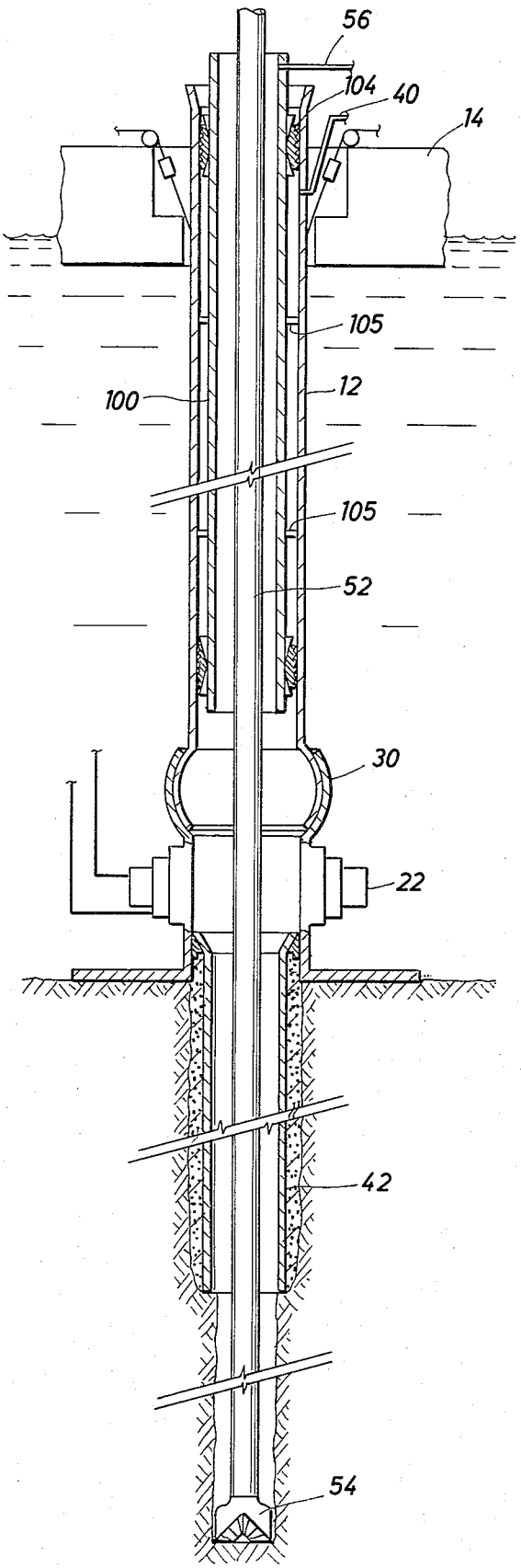
FIG. 6 is a view similar to FIG. 5, but with the liner anchored top and bottom under tension, and showing a drill string and bit.

In FIGS. 5 and 6, the riser tube 12 is extended between the universal joint 30 and the drilling vessel 14 where the riser tube is suspended by cables 24 fitted with tensioners 27. The well is illustrated with a first casing section 42 cemented in place, although the succeeding description of the riser assembly is applicable regardless of the stage of drilling of the well.

A liner 100 is positioned within the riser tube 12. In FIG. 5, the liner 100 is anchored to the riser 12 by means of an anchoring device 102 situated toward the bottom end of the liner. The anchor 102 may be of any conventional design, although a mechanically set anchor is preferred. Further, while the anchoring device 102 must be of a type and orientation to prevent slippage of the liner 100 upwardly relative to the riser 12, anchoring devices which anchor against relative movement in both longitudinal directions may be employed. Thus, the anchoring device 102 schematically illustrated is shown as including both top and bottom wedge devices to urge the anchoring dogs, or slips, radially outwardly to indicate the ability of the anchor to increase the anchoring effect whenever relative longtidunal movement between the liner 100 and the riser 12 is urged in either direction.

Once the liner 100 is anchored by means of the anchoring device 102, tension is applied to the liner by drawing the liner upwardwardly relative to the riser 12. With the liner 102 under such tension, a second anchoring device 104 is set toward the top end of the liner to anchor the liner to the riser at that location. Again, the upper anchoring device 104 may be of any conventional design, although, in this instance, it is required that the upper anchor prevent slippage of the top of the liner 100 downwardly relatively to the riser 12. The upper anchoring device 104 is also schematically illustrated herein as including upper and lower wedging devices to indicate the ability to prevent relative longtidunal movement between the liner 100 and the riser tube 12 in either direction.

Anchoring devices of types that may be used for the upper and lower anchors 102 and 104, respectively, are discussed, for example, in U.S. Pat. Nos. 3,279,542 and 3,294,172. Liner hangers well known in the art, may also be used to anchor the liner 100 to the riser tube 12. In the case of the lower anchoring device 102, such a liner hanger would be of an inverted design to prevent the bottom of the liner from rising relative to the riser tube 12.

The liner 100 is thus prestressed and left under a permanent degree of tension over and above the force normally applied by tensioners to the top of the entire riser. Thus, the liner is left with a permanent degree of tension greater than the weight of the entire riser assembly in water. Then, as the drilling vessel 14 may rise and fall under the influence of wave action, though the tensioners 27 do not react sufficiently to maintain constant tension force on the riser tube 12, the liner 100 will be in a state of permanent tension. If the riser tube 12 tends to bend or sway in the water, the stiffness added to the riser assembly as a whole due to the prestressed liner 100 will increase the resistance of the riser assembly to such bending, thereby preventing, ultimately, buckling by the riser tube.

In FIG. 6, centralizers 105 are schematically shown positioned between the liner 100 and the riser tube 12. Such centralizers 105, known in the art, may be used, particularly in the case of a long riser assembly, to provide added stiffness to the riser assembly, and to further resist its buckling. This is accomplished by the centralizers 105 inhibiting the movement of the riser tube 12 toward the pre-tensioned liner 100, thereby resisting bowing by the riser tube. While two such centralizers 105 are illustrated in FIG. 6, any number of centralizers may be employed as appropriate to maintain the desired degree of rigidity of the riser assembly.

The drill string 52 and drill bit 54 are shown in place in FIG. 6 for continued drilling of well. As indicated hereinbefore, a liner such as that at 100 may be mounted within the riser tube 12 under tension at any stage of the drilling operation, including before drilling has begun. Subsequently, the liner 100 may be replaced with liners of differing diameters, each such liner also being mounted under tension to provide added stiffness to the riser assembly as a whole.

Figure 4:
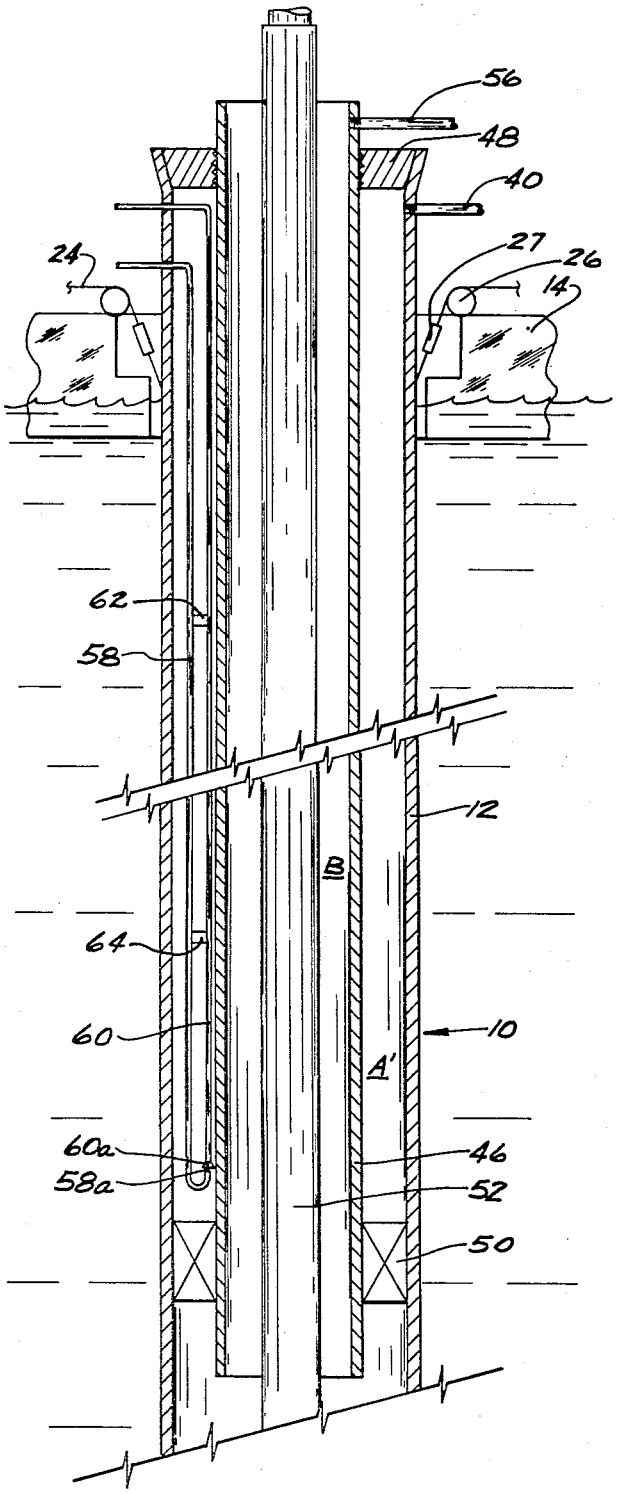
FIG. 4 is an enlarged partial cross sectional view of the riser and liner of FIG. 3, but showing also the gas inlet line and the jet line.

The operation of drilling, or otherwise working, a well through a prestressed riser assembly may proceed generally as described hereinbefore in relation to FIGS. 2–4. The initial segment of the well is drilled through the riser tube 12 and lined with cemented casing 42. The drill string is withdrawn, and the liner 100 is positioned within the riser tube 12. The lower anchor 102 is set, and an upward tensioning force is applied to the liner 100. With the liner 100 under tension, the upper anchor 104 is set, and the mechanism used to apply the tensioning force may be released. The liner 100 is thus left under tension. The drill string 52 is passed down the riser assembly into the well with the drill bit 54 for further drilling.

As an alternative, a pre-tensioned liner may be provided within the riser assembly even to drill the first segment of the well.

As the drilling proceeds, drilling mud is circulated down the drill string, through the bit, up the well and along the riser tube 12 back to the vessel 14. In the present case, this drilling mud may circulate either inside or outside the set liner 100 or both. Conduits 40 and 56 are provided as shown in FIG. 6 for the circulation of the drilling mud out of the riser assembly.

As in the case of the apparatus shown in FIGS. 2–4, the liner 100 may be replaced by liners of different diameters to reduce the weight of the riser assembly as the well gets deeper. When such replacement occurs, the current liner may be removed by releasing the upper anchor 104 then the lower anchor 102, and withdrawing the liner. The replacement liner is then positioned in the riser tube 12, anchored near the liner bottom, placed under tension, and anchored near the liner top. The upper and lower anchoring devices may be replaced with anchors to accomodate the different diameters of the new liner.

Figure 7:
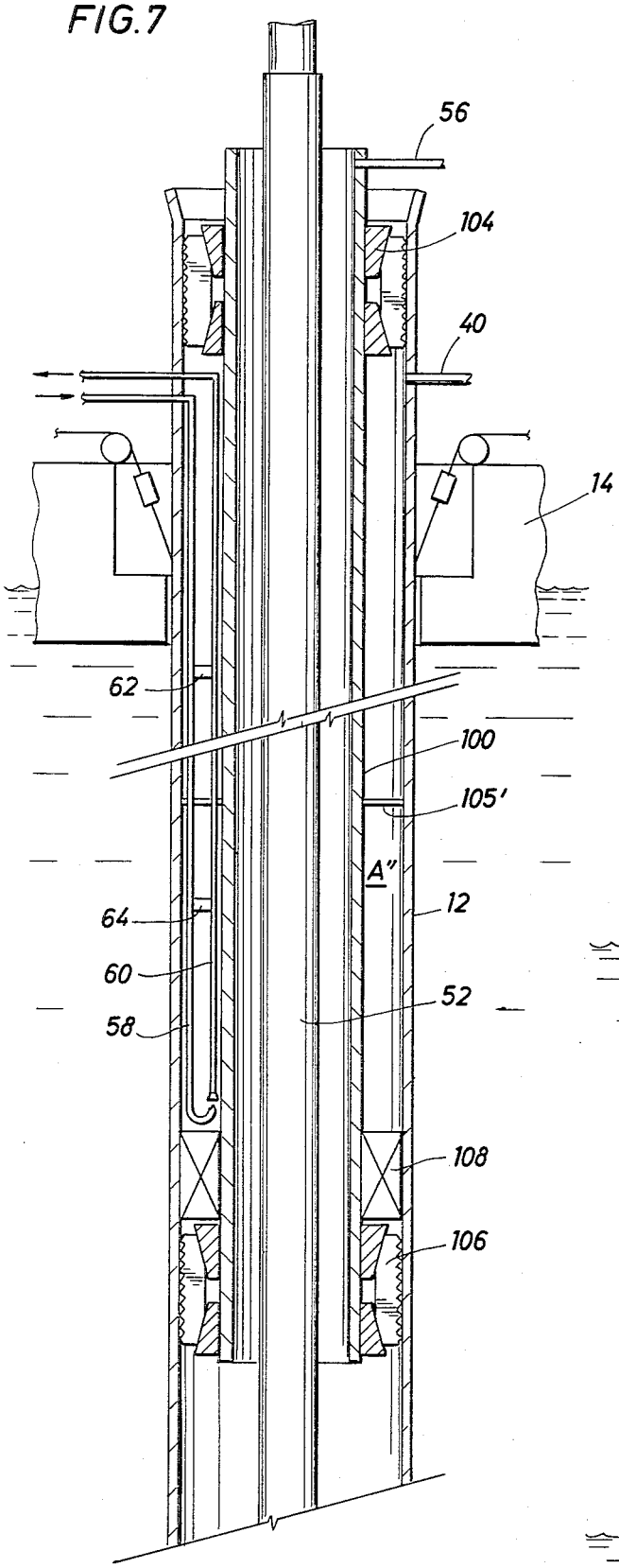
FIG. 7 is a view similar to FIG. 6, but illustrating a liner under tension and sealed to the riser for controlled buoyancy of the riser assembly.

A prestressed liner may also be used in conjunction with the buoyancy control technique described hereinbefore. Such an arrangement is illustrated in FIG. 7. The liner 100 is mounted under tension within the riser tube 12 by a lower anchor 106 and an upper anchor 104. Additionally, a lower seal, such as a packer, 108 is positioned in the vicinity of the lower anchoring device 106. The gas inlet line 58 and jet line 60, with gas lift valves 62 and 64, are positioned within the annular region between the liner 100 and the riser tube 12, in the same fashion as indicated in FIG. 4. Conduits 40 and 56 are provided as fluid communication paths to the interior of the riser 12 and the liner 100, respectively. With the sealing apparatus 108 in place, fluid may be removed from, or added to, the annular region A" between the liner 100 and the riser tube 12 as described hereinbefore in relation to the buoyancy control operations carried out with the apparatus illustrated in FIG. 4. In this case, the return circulation of the drilling mud is along the interior of the liner 100 due to the seal 108, and the mud is removed from the riser assembly by way of conduit 56. The conduit 40 passing through the riser tube 12 is used to add fluid to the region A" to increase the weight of the riser assembly, while the gas inlet line 58, jet line 60, and gas lift valves 62 and 64 (only two shown though any number may be used) are used to increase the buoyancy of the riser assembly.

Thus, the buoyancy of the riser assembly as a whole may be varied from positive to negative buoyancy values as discussed hereinbefore, while the liner 100 is maintained under constant tension for added stiffness of the riser assembly.

It will be appreciated that the lower anchoring device 106 and the sealng apparatus 108 may be individual tools. However, a packer may also be used wherein the packer includes an anchoring device to prevent relative longitudinal movement of the liner 100 relative to the riser 12. Such packers are known in the art.

To employ a prestressed riser assembly with controlled buoyancy, the riser assembly is installed, and drilling proceeds, as discussed hereinbefore. However, in this case, the bottom region of the liner is fluid sealed to the riser tube as well as anchored. This sealing may for example be accomplished after the lower anchoring device 106 is set, and before the liner is pulled up on to place the liner under tension. Where the lower anchor and the sealing device is a single tool in the form of a packer with anchoring mechanism, the packer is set to both seal and anchor the lower end of the liner to the riser tube in essentially one operation, as is well known in the art.

With the liner bottom sealed and anchored to the riser tube, the liner may be pulled up on to stress the liner, and the top anchor 104 set. The gas inlet and jet lines, complete with gas lift valves if desired, may be installed in the region A" between the liner 100 and the riser tube 12, and above the seal 108. Thus, not only is the riser assembly strengthened by the prestressed liner, but the buoyancy of the assembly may be selectively altered and maintained.

As in the case of the riser assembly shown in FIG. 6, any number of centralizers 105' (only one shown) may be positioned between the liner 100 and the riser tube 12 to further strengthen the prestressed riser assembly as described hereinbefore. In the present case, the centralizers are designed to accomodate passage of the gas inlet and jet lines 58 and 60, respectively, along the area A".

The liner 100 may be replaced by liners of smaller diameters as drilling proceeds to not only minimize the weight of the riser assembly and its contents, but to maximize the area A" containing liquid subject to amount and density manipulation to control the riser assembly buoyancy.

Figure 8:
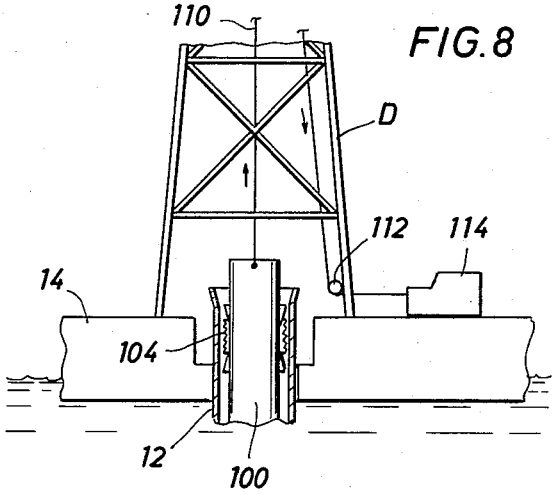
FIG. 8 is a side elevation in partial section of the top of the riser assembly, illustrating use of the drawworks for tensioning the liner.
Figure 9:
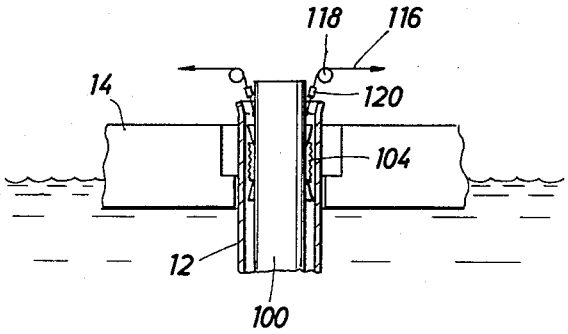
FIG. 9 is a view similar to FIG. 8, showing use of tensioners to pull up on the liner.
Figure 10:
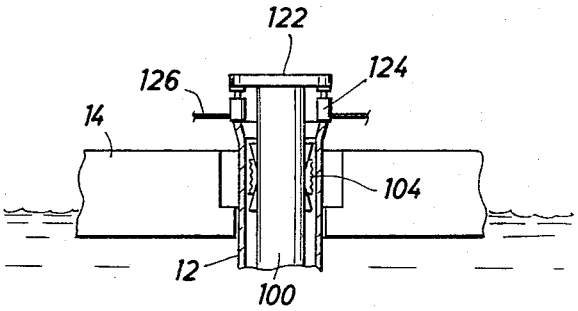
FIG. 10 is a view similar to FIGS. 8 and 9, illustrating use of jacks to apply a differential "pull" to the liner relative to the riser.

FIGS. 8–10 illustrate schematically various techniques for applying tensioning force to a liner for prestressed mounting within the riser tube 12. In each of these FIGS. 8–10, the top of the riser tube 12 and the liner 100 contained therein are shown at the drilling vessel 14. The upper anchoring device 104 is also indicated. However, additional eqiupment related to the riser assembly, such as the tensioning devices 27 and the conduits 40 and 56, shown in FIGS. 1–7 and described in detail hereinbefore, are ommitted for purposes of clarity.

In FIG. 8, a cable 110 is shown attached to the top of the liner and passing upwardly through the derrick D. The cable 110 continues over a sheave, or block, (not shown) mounted on the derrick D, and downwardly around a sheave 112 and to the drawworks 114. Operation of the drawworks 114 pulls the cable 110 up over the sheave near the top of the derrick D and down about the lower sheave 112 into the drawworks, as indicated by the arrows. In this fashion, with the liner 100 locked to the riser tube 12 by a lower anchoring device as described hereinbefore and with the upper anchor 104 in a release configuration, the drawworks may be used to apply tension force to the liner 100 while the weight in water of the riser tube 12, as well as its contents other than the liner, is acting downwardly on the riser itself. With the liner 100 thus held under tension by means of the cable 110 and the drawworks 114, the upper anchoring device 104 is set, locking the top of the liner to the riser tube 12. The cable 110 may then be released and other operations utilizing the riser assembly carried out, as described hereinbefore.

In FIG. 9, cables 116 are joined to the top of the riser 100, and pass over sheaves 118 to winches (not shown) mounted on the drilling vessel 14. Tensioners 120 are in line with the cables 116 and, coupled with the operation of the winches, provide the means for applying tension force to the liner 100. Again, with the upper anchor 104 in a release configuration, and the bottom of the liner 100 anchored to the riser tube 12, the liner may be pulled up on while the riser tube is held down by weight as described in relation to FIG. 8. The upper anchoring device 104 is then set, and the cables 116 may be released. While two such cables 116, and related sheaves 118 and tensioners, are illustrated in FIG. 9, any number of such cable and tensioner assemblies may be employed to prestress the liner 100. Also, the tensioners 120 themselves may be relied upon to apply the tension force to the liner 100 with the ends of the cables 116 merely anchored to the drilling vessel rather than being joined to winches.

In FIG. 10, the liner 100 is shown fitted with a flange, or collar, 122 that extends rigidly outwardly over the riser tube 12. A pair of hydraulic jacks 124 are positioned between the collar 122 and the top of the riser tube 12. Fluid pressure communication lines 126 are shown for connecting the jacks 124 with appropriate fluid pressure control apparatus (not shown). Extension of the jacks 124 by the application of fluid pressure thereto results in the application of upward forces on the collar 122 and, therefore, the liner 100 while at the same time downward forces are applied to the riser 12. With the upper anchor 104 in a release configuration, and the lower anchoring device locking the bottom of the liner 100 to the riser tube 12, the jacks 124 may thus be used to apply a tension force to the liner. With the liner thus under tension, the upper anchoring device 104 may be set as discussed hereinbefore, and the jacks 124 released and removed.

While three particular techniques for applying the tension force to prestress the liner within the riser assembly are disclosed herein, any technique appropriate for applying an upward force on the liner to tension the liner relative to the riser tube may be utilized within the spirit of the invention.

The present invention provides a prestressed riser assembly in which the liner may, for example, be held under tension of the order of the full buoyant weight of the liner and its contents. At the completion of the well drilling or other operation, or whenever the liner is to be replaced the anchoring devices are released, and the liner may be pulled from the riser tube.

Although the present invention is particularly shown herein as applied to underwater well drilling operations, the method and apparatus of the present invention may be used generally to connect any two locations between which a body of fluid is located. Thus, for example, a tube or a pipeline may be extended between two locations underwater, in the place of the liner described herein, and surrounded by a second tube or pipe in the place of the riser. Then, the density and/or amount of liquid in the generally annular region between the pipeline and the outer pipe may be adjusted to control the buoyancy of the entire assembly. Also, a tubular member positioned within a surrounding outer pipe may be anchored under tension within the outer pipe to provide a prestressed conduit structure between any two locations in general. Appropriate sealing, at both ends if necessary, may be added to allow for buoyancy control in a fluid environment according to the present invention.

The foregoing disclosure and description of the invention is illustrative and explanatory thereof, and various changes in method steps as well as in the details of the illustrated apparatus may be made within the scope of the appended claims without departing from the spirit of the invention.

I claim:

1. A riser assembly for connecting a marine well operating facility with a well site which is submerged in water comprising:

(a) riser tube means having a first end flexibly joined to said operating facility and a second end flexibly joined to said submerged site;

(b) liner means, positioned generally within said riser tube means, having a first end and a second end generally toward said first end and said second end of said riser tube means, respectively;

(c) lower anchoring means for anchoring said liner means to said riser tube means for preventing upward movement of said second end of said liner means relative to said riser tube means;

(d) upper anchoring means for anchoring said liner means to said riser tube means for preventing downward movement of said first end of said liner means relative to said riser tube means such that said upper and lower anchoring means may cooperate for maintaining said liner means under tension;

(e) seal means for fluid sealing said liner means to said riser tube means generally toward said second end of said liner means, thereby defining a lower end of a generally annular region defined between the radially inner surface of said riser tube means and the radially outer surface of said liner means so positioned within said riser tube means; and (f) gas input means for selectively introducing gas into said generally annular region for generally increasing the buoyancy of said riser assembly by decreasing the density or the amount, or both, of liuqid in said generally annular region.

2. A riser assembly as defined in claim 1 wherein said lower anchoring means and said seal means comprise packer means equipped with anchoring means.

3. A riser assembly as defined in claim 1 wherein said upper anchoring means comprises liner hanger means.

4. A riser assembly as defined in claim 1 wherein at least one of said upper and lower anchoring means is constructed to prevent longitudinal motion of said liner means relative to said riser tube means in both relative longitudinal directions.

5. A riser assembly as defined in claim 1 further comprising well drilling equipment for drilling a well bore at said submerged site by extending said well drilling equipment through said liner means to said submerged site.

6. A riser assembly as defined in claim 5 wherein said well drilling equipment includes:

(a) drill string means for extending from said operating facility through said liner means to said submerged site, and into said well bore being drilled; and (b) drill bit means, driven by said drill string means, for drilling said well bore.

7. A riser assembly as defined in claim 6 wherein said well drilling eqiupment further includes well casing means for lining said well bore.

8. A riser assembly as defined in claim 1 wherein said gas input means includes:

(a) jet line means for extending into said generally annular region for providing means of egress of fluid from within said region; and (b) gas inlet line means for extending into said generally annular region for introducing gas into said jet line means for decreasing the density of liquid within said jet line means.

9. A riser assembly as defined in claim 8 wherein said jet line means includes a flared end, and said gas inlet line means includes an end having a check valve for preventing liquid from entering said gas inlet line means at said end, such that gas flow may be directed from said gas inlet line means end through fluid in said generally annular region and into said jet line means flared end.

10. A riser assembly as defined in claim 9 further comprising gas lift valve means, included in said gas input means, for connecting said gas inlet line means with said jet line means at at least one position within said generally annular region for selectively transmitting gas from said gas inlet line means to said jet line means.

11. A riser assembly as defined in claim 10 or, in the alternative, as defined in claim 1 further comprising liquid input means for selectively introducing liquid into said generally annular region for generally decreasing the buoyancy of said riser assembly.

12. An assembly for communicating a first location with a second location, wherein said assembly extends through a body of fluid, comprising:

(a) first tube means extending continuously generally between said first location and said second location;
(b) second tube means positioned generally within said first tube means;
(c) first anchor means and second anchor means for anchoring said second tube means to said first tube means at two positions and for thereby maintaining said second tube means under tension;
(d) seal means for at least partially closing off an area generally defined between the inner surface of said first tube means and the outer surface of said second tube means;
(e) fluid means; and
(f) pump means for selectively adjusting and maintaining said fluid means in said area in quantity and density to selectively control the buoyancy of said assembly relative to said fluid body.

13. A method of providing a connection between a first location and a second location, between which locations a body of fluid is located, comprising the steps of:
(a) extending a first tube means between said first location and said second location, through said body of fluid;
(b) positioning a second tube means generally within said first tube means, and anchoring said second tube means to said first tube means at two separated positions with said second tube means under tension greater than that of said first tube means;
(c) at least partially fluid sealing said second tube means to said first tube means; and
(d) selectively controlling the density and amount of liquid in the area generally between the inner surface of said first tube means and the outer surface of said second tube means to one side of said sealing by pumping liquid into or out of said area.

14. A method as defined in claim 13 further comprising the step of selectively pumping liquid out of said area by pumping gas into said area to aerate at least a portion of said liquid, thereby decreasing its density to permit larger density liquid in said area to force the resulting lower density liquid out of said area.

15. A method of operating on an underwater well from a marine drilling facility comprising the steps of:
(a) flexibly joining a riser tube at the drilling facility and at the well site;
(b) positioning a liner generally within the riser tube and anchoring the liner, near its lower end, to the riser tube;
(c) pulling up on the liner and, while the liner is thus stressed, anchoring the liner, near its upper end, to the riser tube against downward movement relative to the riser tube, leaving the liner under tension;
(d) fluid sealing the liner to the inner surface of the riser tube generally at the lower end of the liner, thereby defining a generally annular region between the outer surface of the liner and the inner surface of the riser tube, extending generally upwardly from the fluid seal; and
(e) selectively controlling the buoyancy of the riser tube and its contents by adjusting the density or amount, or both, of liquid within the generally annular region.

16. A method as defined in claim 15 wherein the step of pulling up on the liner to place the liner under tension is carried out by pulling up on cable means joined to the liner.

17. A method as defined in claim 15 wherein the step of pulling up on the liner to place the liner under tension is carried out by pulling up on cable means, joined to the liner, by operation of tensioners and winch means.

18. A method as defined in claim 15 wherein the step of pulling up on the liner to place the liner under tension is carried out by pulling up on the liner by fluid-pressure jack means while said jack means apply downward force to the riser tube.

19. A method as defined in claim 15 further comprising the additional step, carried out before the liner is positioned within the riser tube, of drilling a segment of the well bore by means of a drill bit operated at the end of a drill string passing through the riser tube.

20. A method as defined in claim 19 further comprising the following additional steps, carried out after the liner is positioned within the riser tube and anchored therein under tension:
(a) further drilling the well bore by means of a drill bit operated at the end of a drill string passing through the liner; and
(b) lining the well bore with casing.

21. A method as defined in claim 15 further comprising selectively introducing gas into the generally annular region to gas lift liquid from that region to selectively increase the buoyancy of the riser tube and its contents.

22. A method as defined in claim 21 and, in the alternative, as defined in claim 18 further comprising selectively adding liquid to the generally annular region to selectively decrease the buoyancy of the riser tube and its contents.

23. A method as defined in claim 15 further comprising the steps of:
(a) providing at least one jet line and a gas inlet line for each such jet line, extending down into the generally annular region such that gas may flow out of each gas inlet line and into a corresponding jet line within the generally annular region; and
(b) selectively communicating gas down at least one gas inlet line to flow into such corresponding jet line to aerate liquid contained therein to lower the density of said liquid.

24. A method as defined in claim 23 further comprising the step of selectively continuing to communicate gas down at least one gas inlet line to flow into such corresponding jet line to aerate liquid contained therein to lower the denisty of said liquid so that higher density liquid entering such jet line propels liquid of lower density up the jet line and out of the generally annular region.

25. A method as defined in claim 24 and, in the alternative, as defined in claim 23 further comprising the steps of:
(a) providing selective gas flow means between at least one gas inlet line and corresponding jet line within the generally annular region; and
(b) selectively communicating gas from at least one gas inlet line through said selective gas flow means to such corresponding jet line for selectively reducing the density of liquid in said jet line.

26. A method as defined in claim 15 further comprising the additional steps of:
(a) drilling the well bore by means of a drill bit operated at the end of a drill string passing through the liner; and (b) lining the well bore with casing.

27. A method as defined in claim 26 further comprising the additional steps of:

(a) replacing the liner, anchored under tension within the riser tube, by a liner with smaller diameter after a well bore segment is lined with casing; and (b) drilling subsequent well bore segments with a drill bit of narrower cross section after the replacement of the liner.

28. A method of drilling an underwater well from a marine drilling facility comprising the steps of:

(a) connecting the drilling facility with the well site by a riser tube, flexibly joined to the drilling facility at the top of the riser tube, and flexibly joined to the well site at the bottom of the riser tube;

(b) positioning a liner generally within the riser tube and anchoring the bottom of said liner against upward movement relative to the riser tube;

(c) applying generally upwardly directed force to said liner to place said liner under tension;

(d) anchoring the top of said liner against downward movement relative to said riser tube while said liner is so under tension;

(e) drilling the well bore by a drill bit directed by a drill string extending from the drilling facility down through the liner to the well site; and (f) circulating drilling fluid from the drilling facility down through the drill string, out into the well bore, up through the riser tube and liner surrounding the drill string, and back to the drilling facility.

29. A method as defined in claim 28 further comprising the steps of:

(a) lining the well bore with casing after a segment of the well bore has been drilled;

(b) replacing the liner with a subsequent liner of smaller diameter, set, under tension, within the riser tube as the original liner; and (c) drilling a subsequent segment of the well bore with a subsequent drill bit of smaller lateral cross section operated at the end of a drill string passing through the subsequent liner.

30. A method as defined in claim 29 further comprising the steps of repeating the steps of lining the well bore with casing, replacing the liner with one of smaller diameter set, under tension, within the riser tube, and further drilling the well bore with a drill bit of reduced cross section operated at the end of a drill string passing through the liner of smaller diameter.

31. A method of drilling an underwater well from a marine drilling facility comprising the steps of:

(a) connecting the drilling facility with the well site by a riser tube, flexibly joined to the drilling facility at the top of the riser tube, and flexibly joined to the well site at the bottom of the riser tube;

(b) positioning a liner generally within the riser tube, anchoring the bottom of said liner against upward movement relative to the riser tube, and fluid sealing the liner to the riser tube at the bottom of the liner to define a generally annular region between the inner surface of the riser tube and the outer surface of the liner and extending generally upwardly from the fluid sealing;

(c) applying generally upwardly directed force to said liner to place said liner under tension;

(d) anchoring the top of said liner against downward movement relative to said riser tube while said liner is so under tension;

(e) providing at least one jet line extending downwardly into the generally annular region;

(f) providing a gas inlet line, for each jet line, also extending downwardly into the generally annular region and positioned so that gas may communicate out of the one or more gas inlet lines into the corresponding one or more jet lines;

(g) controlling the buoyancy of the riser tube and its contents by selectively communicating gas down the one or more gas inlet lines and into the corresponding one or more jet lines to aerate liquid within the one or more jet lines to permit said aerated liquid to be propelled upwardly by liquid of larger density;

(h) drilling the well bore by a drill bit directed by a drill string extending from the drilling facility down through the liner to the well site; and (i) circulating drilling fluid from the drilling facility down through the drill string, out into the well bore, up through the liner surrounding the drill string, and back to the drilling facility.

32. A method as defined in claim 31 further comprising the step of further controlling the buoyancy of the riser tube and its contents by selectively adding liquid to the generally annular region.

33. A method as defined in claim 31 further comprising the steps of:

(a) providing at least one gas lift valve connecting the one or more gas inlet lines with the corresponding one or more jet lines; and (b) further controlling the buoyancy of the riser tube and its contents by selectively communicating gas from the one or more gas inlet lines to the corresponding one or more jet lines by the one or more gas lift valves at at least one point along said one or more gas inlet and jet lines.

34. A method as defined in claim 31 further comprising the steps of:

(a) lining the well bore with casing after a segment of the well bore has been drilled;

(b) replacing the liner with a subsequent liner of smaller diameter, set, under tension, within the riser tube as the original liner; and (c) drilling a subsequent segment of the well bore with a subsequent drill bit of smaller lateral cross section operated at the end of a drill string passing through the subsequent liner.

35. A method as defined in claim 34 further comprising the steps of repeating the steps of lining the well bore with casing, replacing the liner with one of smaller diameter set, under tension, within the riser tube, and further drilling the well bore with a drill bit of reduced cross section operated at the end of a drill string passing through the liner of smaller diameter.

* * * * *

UNITED STATES PATENT AND TRADEMARK OFFICE

CERTIFICATE OF CORRECTION

PATENT NO. : 4,216,834

DATED : August 12, 1980

INVENTOR(S) : Harold W. R. Wardlaw

It is certified that error appears in the above-identified patent and that said Letters Patent are hereby corrected as shown below:

In Claim 1, Column 16, line 9, delete the word "liuqid", and insert therefor --liquid--.

In Claim 22, Column 18, line 31, after the word "claim", delete the number "18", and insert therefor --15--.

Signed and Sealed this

*Sixteenth* Day of *June 1981*

[SEAL]

*Attest:*

RENE D. TEGTMEYER

*Attesting Officer*

*Acting Commissioner of Patents and Trademarks*